US008882245B2

(12) United States Patent
Miyazawa

(10) Patent No.: US 8,882,245 B2
(45) **Date of Patent: *Nov. 11, 2014**

(54) INKJET HEAD AND METHOD OF MANUFACTURING THE SAME

(75) Inventor: Toshio Miyazawa, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/533,096

(22) Filed: Jun. 26, 2012

(65) Prior Publication Data

US 2013/0002768 A1 Jan. 3, 2013

(30) Foreign Application Priority Data

Jul. 1, 2011 (JP) ..... 2011-147102

(51) Int. Cl.

| | |
|---|---|
| ***B41J 2/045*** | (2006.01) |
| ***B41J 2/16*** | (2006.01) |
| ***B41J 2/14*** | (2006.01) |

(52) U.S. Cl.

CPC ..... *B41J 2/1637* (2013.01); *B41J 2/14209* (2013.01); *B41J 2/1609* (2013.01); *B41J 2/1623* (2013.01); *B41J 2/1631* (2013.01); *B41J 2/1632* (2013.01); *B41J 2/1643* (2013.01); *B41J 2002/14491* (2013.01)

USPC ..... 347/68; 347/71; 347/69; 347/72

(58) Field of Classification Search

USPC ..... 347/68–72; 29/890.01

See application file for complete search history.

(56) References Cited

U.S. PATENT DOCUMENTS

| | | | | |
|---|---|---|---|---|
| 2002/0008741 | A1 | 1/2002 | Temple et al. | |
| 2002/0135643 | A1 | 9/2002 | Sarojiniamma et al. | |
| 2011/0032311 | A1* | 2/2011 | Miyazawa | 347/71 |
| 2012/0050413 | A1 | 3/2012 | Miyazawa | |
| 2012/0229579 | A1* | 9/2012 | Kushida et al. | 347/71 |

FOREIGN PATENT DOCUMENTS

| | | |
|---|---|---|
| JP | 2009-196122 | 9/2009 |
| JP | 2009-202475 | 9/2009 |
| JP | 2009-220528 | 10/2009 |

OTHER PUBLICATIONS

Japanese Office Action for Japanese Application No. 2012-146592 mailed on Feb. 4, 2014.

* cited by examiner

*Primary Examiner* — Henok Legesse

(74) *Attorney, Agent, or Firm* — Amin, Turocy & Watson, LLP

(57) ABSTRACT

An inkjet head includes a substrate, a piezoelectric member provided on the substrate and having predetermined length, plural pressure chamber grooves provided on the piezoelectric member in a longitudinal direction, opposed walls forming the pressure chamber grooves being configured to function as driving elements that eject ink, a chamber groove provided along the longitudinal direction of the piezoelectric member, the chamber groove being formed on the substrate continuously to a slope of the piezoelectric member, an insulating member provided in the chamber groove, a wire through which a signal for driving the walls of the pressure chamber grooves passes, the wire being formed on the substrate and the insulating member, a cover member opposed to the substrate and configured to cover the piezoelectric member and the chamber groove, and plural nozzles configured to pierce through the cover member, respectively communicate with the pressure chamber grooves, and discharge the ink.

20 Claims, 9 Drawing Sheets

INKJET HEAD AND METHOD OF MANUFACTURING THE SAME

CROSS-REFERENCE TO RELATED APPLICATION

This application is based on and claims the benefit of priority from Japanese Patent Application No. 2011-147102, Jul. 1, 2011, the entire contents of which are incorporated herein by reference.

FIELD

Embodiments described herein relate generally to an inkjet head used in a printer and the like and a method of manufacturing the inkjet head.

BACKGROUND

As an inkjet head in the past, there is known a head manufactured by forming plural pressure chamber grooves in a piezoelectric member side by side and, after forming electrodes on the inner surfaces of the pressure chamber grooves, bonding a cover to crosslink plural walls that partition the pressure chamber grooves. As a substrate that holds the piezoelectric member, in general, a substrate made of alumina is used.

In the manufacturing process for the inkjet head, there is a step of forming an inclined surface of the piezoelectric member. In the step, the surface of the substrate made of alumina is also ground. Since the ground surface of the substrate made of alumina is easily smoothed compared with the piezoelectric member, it is likely that the adhesion force of plating on the ground surface of the substrate is weakened. In order to solve this problem, there is known an inkjet head in which the surface is roughed by etching to improve the adhesion force of the plating on the ground surface of the substrate. In this step, if immersion treatment with etching liquid is performed in a state in which the substrate made of alumina and the piezoelectric member are bonded, it is likely that the piezoelectric member is excessively roughed.

DETAILED DESCRIPTION

In general, according to one embodiment, an inkjet head includes: a substrate; a piezoelectric member provided on the substrate and having predetermined length; a plurality of pressure chamber grooves provided on the piezoelectric member in a longitudinal direction, opposed walls forming the pressure chamber grooves being configured to function as driving elements that eject ink; a chamber groove provided along the longitudinal direction of the piezoelectric member, the chamber groove being formed on the substrate continuously to a slope of the piezoelectric member; an insulating member provided in the chamber groove; a wire through which a signal for driving the walls of the pressure chamber grooves passes, the wire being formed on the substrate and the insulating member; a cover member opposed to the substrate and configured to cover the piezoelectric member and the chamber groove; and a plurality of nozzles configured to pierce through the cover member, respectively communicate with the pressure chamber grooves, and discharge the ink.

The inkjet head according to the embodiment is explained in detail below with reference to the accompanying drawings.

Figure 1:
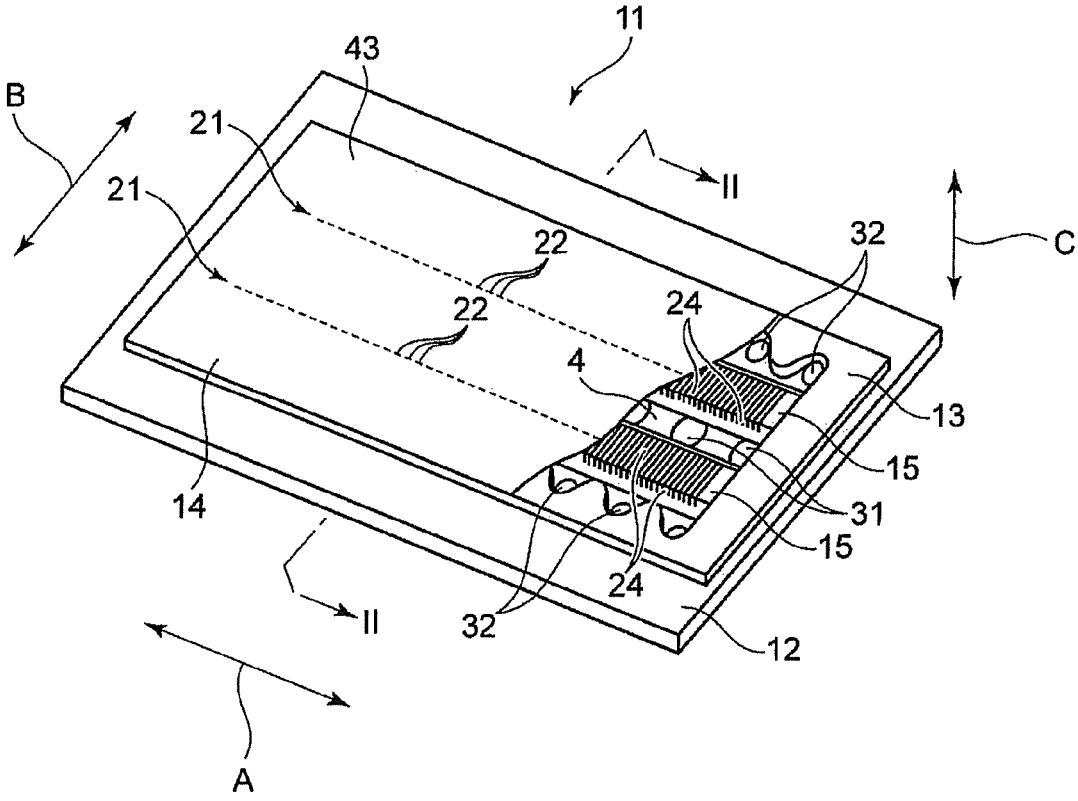
FIG. 1 is an external perspective view of an inkjet head according to an embodiment.
Figure 2:
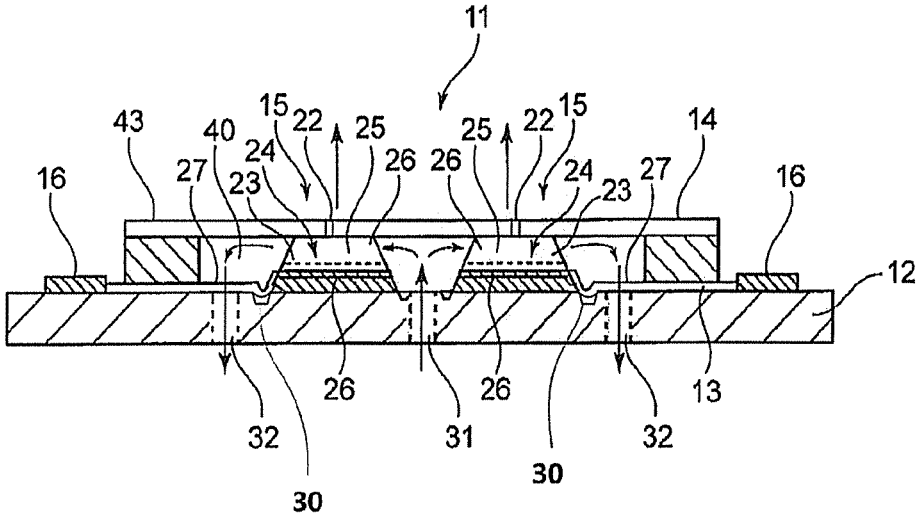
FIG. 2 is a sectional view of the inkjet head shown in FIG. 1 taken along line II-II.

FIG. 1 is an external perspective view of an inkjet head 11 according to the embodiment. In FIG. 1, a part of a configuration is shown partially cut away in order to explain the internal structure of the inkjet head 11. FIG. 2 is a sectional view of the inkjet head 11 shown in FIG. 1 taken along line II-II. The inkjet head 11 according to this embodiment is an inkjet head of a side shooter type of an ink circulation system.

As shown in FIGS. 1 and 2, the inkjet head 11 includes a substantially rectangular tabular substrate 12 made of alumina, a frame member 13 bonded on the surface of the substrate 12, a substantially rectangular tabular cover member 14 bonded to an end of the frame member 13 separated from the substrate 12, a pair of piezoelectric members 15 bonded on the surface of the substrate 12 on the inner side of the frame member 13, and plural ICs 16 (see FIG. 2) for head driving for driving the pair of piezoelectric members 15.

The substrate 12 is made of, for example, an alumina material, which is an insulating body. Alumina ($Al_2O_3$) is a common name of aluminum oxide. Alumina is white powder also called alumina ceramic. The formula weight of alumina is 102.00 g/mol. The melting point of alumina is about 2020° C. The boiling point of alumina is about 3000° C.

Alumina is a chemically stable material and is excellent in abrasion resistance. Alumina is not eroded by most acids and alkalis.

Alumina is used as the material of fine ceramics. Among materials of fine ceramics, alumina has particularly excellent characteristics. Fine ceramics is also called new ceramics or advanced ceramics. Fine ceramics is a chemical composition precisely prepared using refined or composed raw material powder. Fine ceramics is highly precise ceramics and manufactured by controlled molding and a sintering method. As the material of the substrate 12, it is desirable to use alumina. In general, fine ceramics is used in a semiconductor, an automobile, an industrial machine, and the like.

As shown in FIG. 2, plural supply ports 31 pierce through the substrate 12.

The plural supply ports 31 are arranged side by side on a substantially center line of the substrate 12 along a longitudinal direction of the substrate 12 indicated by an arrow A in FIG. 1.

Plural discharge ports 32 pierce through the substrate 12. The plural discharge ports 32 are arranged closer to edges of the substrate 12 along the longitudinal direction A of the substrate 12. The edges are both ends (opposed ends) in a direction (a width direction) indicated by an arrow B orthogonal to the longitudinal direction A of the substrate 12.

The material of the frame member 13 is ceramic. The surface of the frame member 13 is covered with an insulating material. The material of the frame member 13 is not limited to ceramic and may be metal.

The cover member 14 is provided on the substrate 12 across the frame member 13. The cover member 14 is made of polyimide. The cover member 14 includes a pair of nozzle rows 21. Each of the nozzle rows 21 includes plural nozzles 22, which are ejection holes for ink droplets. The plural nozzles 22 are arranged side by side at substantially equal intervals and linearly. A water repellent film 43 is provided on the surface on an ink droplet ejection side (the outer surface) of the cover member 14. The water repellent film 43 is desirably, for example, fluorine resin.

As shown in FIG. 2, the pair of piezoelectric members 15 are obtained by sticking together two piezoelectric plates 23. The two piezoelectric plates 23 are stuck together such that polarization directions thereof are opposed to each other. The piezoelectric plates 23 are made of, for example, PZT (lead zirconate titanate). Each of the piezoelectric members 15 is formed in a bar shape extending in the longitudinal direction A. The cross section in the width direction B of each of the piezoelectric members 15 is formed in a trapezoidal shape.

As shown in FIG. 1, the plural supply ports 31 are arranged side by side along the longitudinal direction A between the two piezoelectric members 15. Similarly, the plural discharge ports 32 are arranged side by side along the longitudinal direction A. The plural supply ports 31 and the plural discharge ports 32 are provided in positions across each of the piezoelectric members 15.

In each of the piezoelectric members 15, plural fine elongated pressure chamber grooves 24 are formed. The plural pressure chamber grooves 24 are arranged side by side at equal intervals in the longitudinal direction A. In this way, plural walls 25 for partitioning the pressure chamber grooves 24 are formed in each of the piezoelectric members 15. The plural walls 25 function as driving elements. In other words, the driving elements form both side sections of each of the pressure chamber grooves 24.

Electrodes 26 are provided on the inner surface of each of the pressure chamber grooves 24. Specifically, the electrodes 26 are provided on the two walls 25 adjacent to each other, side surfaces opposed to the pressure chamber groove 24, and the bottom of the pressure chamber groove 24 between the side surfaces.

The cover member 14 is bonded to ends 25*a* (see FIG. 6) of the walls 25 that partition the pressure chamber grooves 24. The nozzles 22 are provided in the cover member 14 to correspond to the pressure chamber grooves 24. In other words, the nozzles 22 are formed at the same pitch as the pressure chamber grooves 24.

The cover member 14 is bonded to an end of the frame member 13 separated from the substrate 12 besides the ends 25*a* of the walls 25. Consequently, an ink chamber 40 surrounded by the substrate 12, the frame member 13, and the cover member 14 is formed.

Plural electric wires 27 for driving the piezoelectric members 15 are provided on the substrate 12. One end of each of the electric wires 27 is connected to the electrode 26. The other end of each of the electric wires 27 is connected to the IC 16 for head driving provided on the substrate 12. As a base of the electric wires 27 provided on the surfaces of the substrate 12 and the piezoelectric members 15, an insulating member 60 explained below (see FIGS. 5A, 5B, and 5C) made of resin or the like is formed.

The operation of the inkjet head according to this embodiment is explained. For example, printing is executed in a well-known printer in the past (not shown in the figures) mounted with the inkjet head 11 having the structure explained above. First, ink is supplied from a not-shown ink tank of the printer to the inkjet head 11. Arrows in FIG. 2 indicate a flow of ink.

The ink is supplied to the inkjet head 11 via the plural supply ports 31 formed in the substrate 12. The ink flows into the chamber 40 generally sealed by the substrate 12, the frame member 13, and the cover member 14. The ink further flows to the outer sides of the substrate 12 through the pressure chamber grooves 24. The ink is discharged from the inkjet head 11 via the plural discharge ports 32.

At this point, a supply pressure and a discharge amount of the ink supplied to the inkjet head 11 are set to values enough for washing away air bubbles adhering to the inner wall of the chamber 40. The values need to be set to prevent the ink from being pushed out from the plural nozzles 22 of the cover member 14. In other words, the ink supplied to the inkjet head 11 circulates to generally fill the chamber 40. The ink supplied to the inkjet head 11 circulates not to be held up. The ink not used in the inkjet head 11 is discharged via the discharge ports 32. The discharged ink is collected in a not-shown ink tank.

When a user instructs the printer to perform printing, a not-shown control section of the printer outputs a printing signal to the ICs 16 for head driving of the inkjet head 11. The ICs 16 for head driving receive the printing signal and apply a driving pulse voltage to the walls 25 (the driving elements) via the electric wires 27. A pair of left and right walls 25 provided on both the sides of the pressure chamber groove 24 selected to be caused to eject ink droplets are deformed in a shear mode. When deformed in the shear mode, the pair of walls 25 separate from each other while bending and increase the volume of the pressure chamber groove 24. An amount of the ink in the pressure chamber groove 24 increases by the increase in the volume. Then, the pair of walls 25 are returned to the initial positions to increase the pressure in the pressure chamber groove 24. When the pressure in the pressure chamber groove 24 is increased, ink droplets are ejected from the opposed nozzles 22. This operation is repeated to print an image on a sheet.

Figure 3:
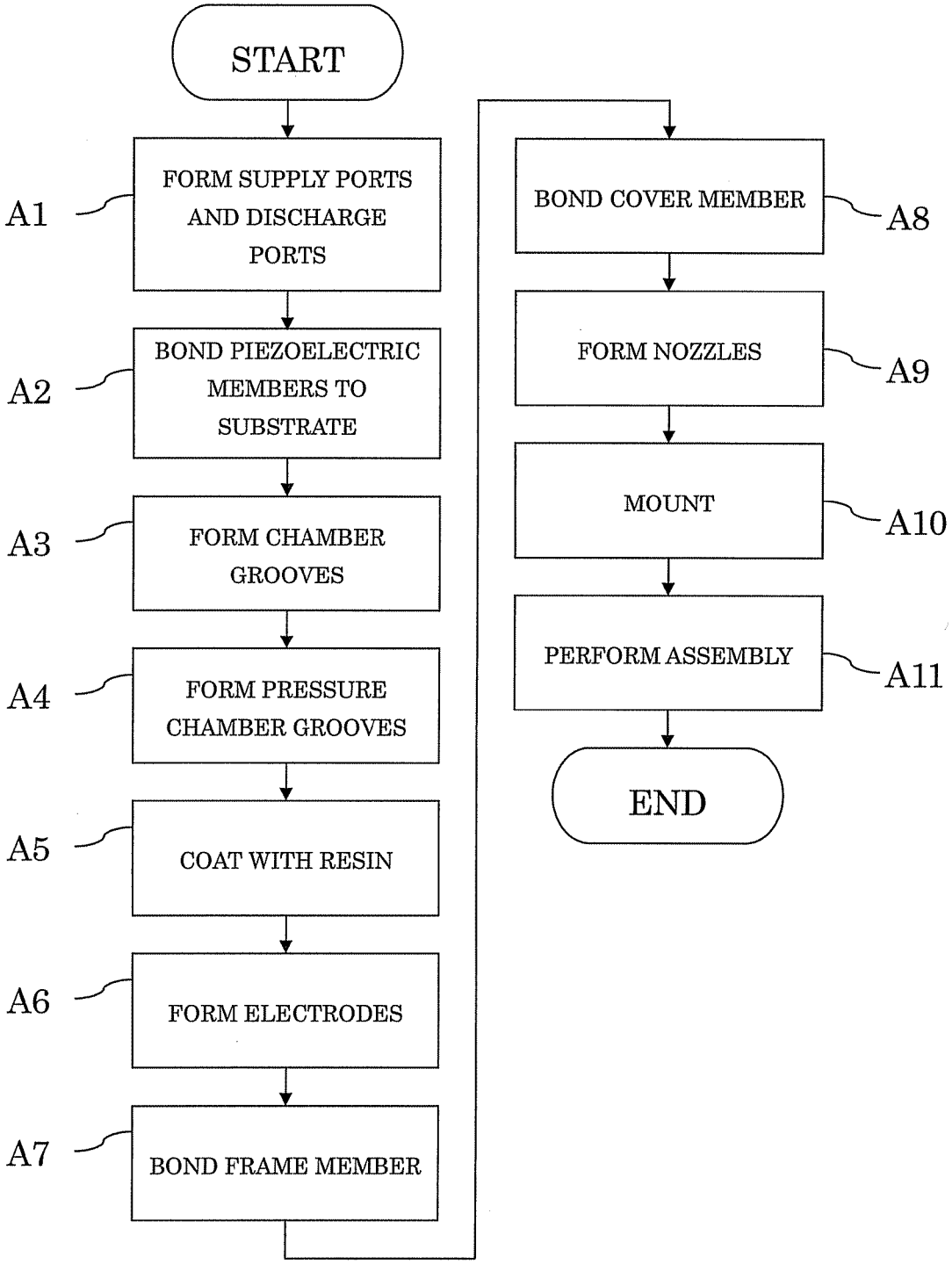
FIG. 3 is a flowchart for explaining a method of manufacturing the inkjet head shown in FIG. 1.

A method of manufacturing the inkjet head 11 is explained with reference to a flowchart of FIG. 3 and schematic diagrams of FIGS. 4 to 7.

First, the plural supply ports 31 and the plural discharge ports 32 are formed (Act A1). The plural supply ports 31 and the plural discharge ports 32 are formed in the substrate 12 formed of, for example, a baked alumina ceramics sheet. Positional accuracy of the supply ports 31 and the discharge ports 32 may be low. The substrate 12 may be formed of an unbaked alumina ceramics sheet. Besides, the plural supply ports 31 and the plural discharge ports 32 may be formed by press molding. Further, the plural supply ports 31 and the plural discharge ports 32 may be formed by machining the rectangular tabular substrate 12.

Subsequently, the pair of piezoelectric members 15 are bonded to the surface of the substrate 12 (Act A2). Each of the piezoelectric members 15 is located on both the sides of the supply port 31. Each of the piezoelectric members 15 is provided between the supply port 31 and the discharge port 32. At this point, a not-shown jig holds the pair of piezoelectric members 15. The pair of piezoelectric members 15 are highly accurately positioned.

Figure 4:
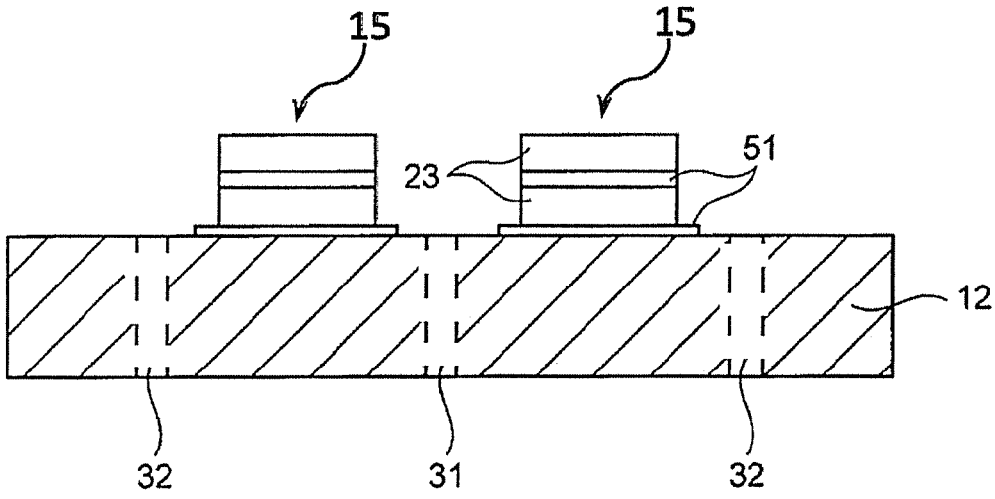
FIG. 4 is a sectional view of a state in which piezoelectric members are bonded to a substrate.

FIG. 4 is a diagram of a state in which the pair of piezoelectric members 15 are bonded to the substrate 12. In the piezoelectric member 15, the two piezoelectric plates 23 are stuck together across an adhesive 51 such that polarization directions of the piezoelectric plates 23 are opposite. The adhesive 51 for sticking together the two piezoelectric plates 23 is hardened by heating. In this embodiment, the adhesive 51 is hardened, for example, when heated at 120° C. for two hours. The adhesive 51 is desirably an epoxy adhesive. The adhesive 51 for sticking the piezoelectric member 15 to the substrate 12 is also desirably the epoxy adhesive. The adhesive 51 is desirably applied not to leave air bubbles between the adhesive 51 and a member to be bonded. This is for the purpose of preventing plating from intruding into air bubbles in an electrode forming step explained below. However, it is conceivable that air bubbles are left and plating intrudes into the air bubbles. If an amount of the air bubbles is small, the insulating member 60 in this embodiment can prevent plating from intruding into the air bubbles.

After the piezoelectric members 15 are bonded to the substrate 12, in Act A3, grinding is performed to provide chamber grooves 30 on slopes 15*a* and 15*b* of the piezoelectric member 15 and the substrate 12. The chamber grooves 30 form a part of the chamber 40. The chamber grooves 30 are formed along the longitudinal direction A of each of the piezoelectric members 15. The chamber grooves 30 are formed using, for example, a blade having a reduced circumference. The edge of the blade is moved from the side of the piezoelectric member 15 to the side of the substrate 12. Consequently, the chamber grooves 30 having slopes continuous to the slopes 15*a* and 15*b* of the piezoelectric member 15 are provided on the substrate 12. (See FIG. 5A)

An unnecessary portion of the adhesive 51 that bonds the substrate 12 and the piezoelectric member 15 can be scraped off by this grinding. If the adhesive 51 is insufficient between the substrate 12 and the piezoelectric member 15, a hollow portion caused by the insufficiency can be scraped off by the grinding.

Figure 6:
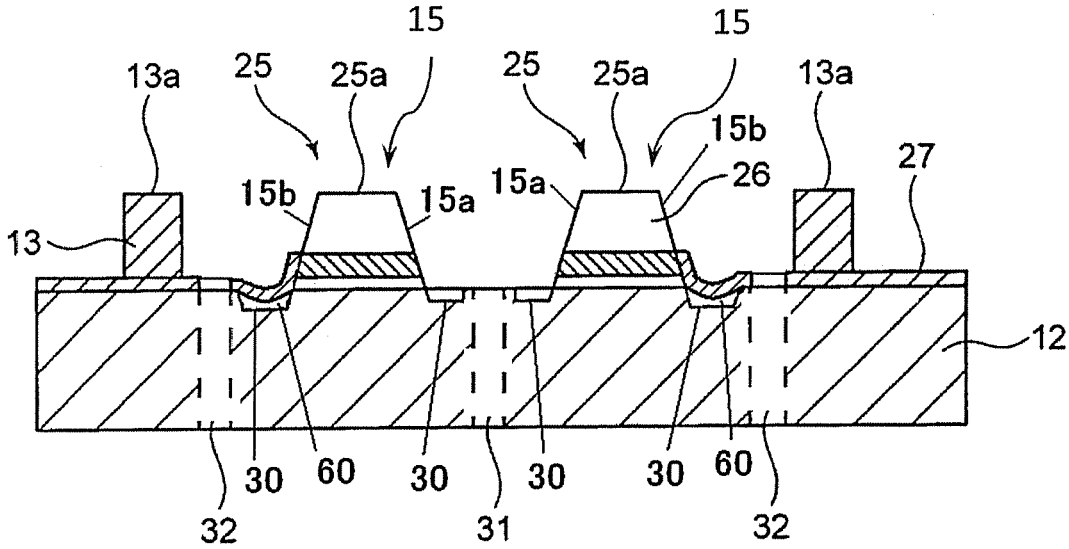
FIG. 6 is a sectional view of a state in which an electrode and a wire are formed and a frame member is bonded.

Thereafter, in the formation of the pressure chamber grooves in Act A4, the plural pressure chamber grooves 24 shown in FIG. 2 are formed in the piezoelectric member 15. The pressure chamber grooves 24 are machined using, for example, a diamond wheel of a dicing saw used for, for example, cutting of an IC wafer. As shown in FIG. 1, the plural pressure chamber grooves 24 are formed side by side at equal intervals along the longitudinal direction A of the piezoelectric member 15. As a result, as shown in FIG. 6, the walls 25 are respectively formed among the pressure chamber grooves 24 adjacent to one another.

Figure 5A:
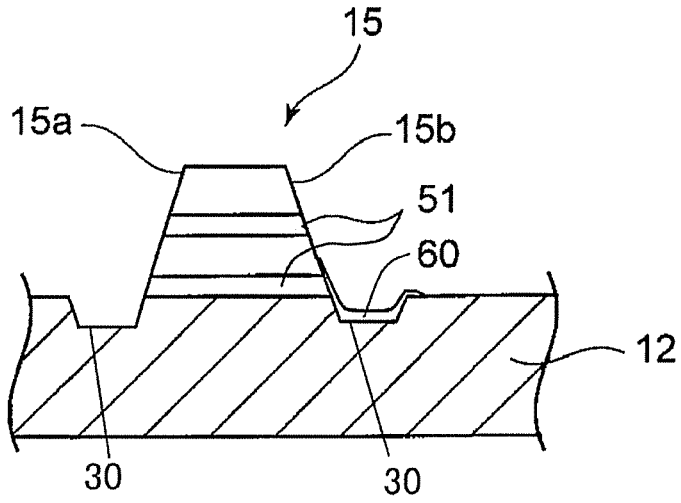
FIG. 5A is a sectional view of a state in which an insulating member is formed in chamber grooves.
Figure 5B:
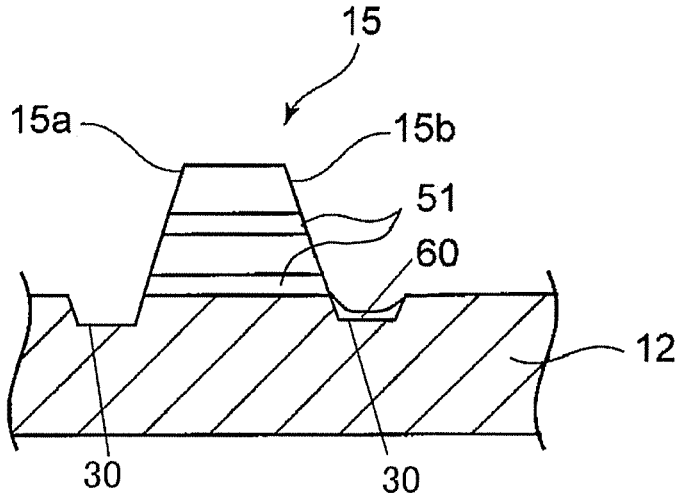
FIG. 5B is another example of the sectional view of the state in which the insulating member is formed in the chamber grooves.
Figure 5C:
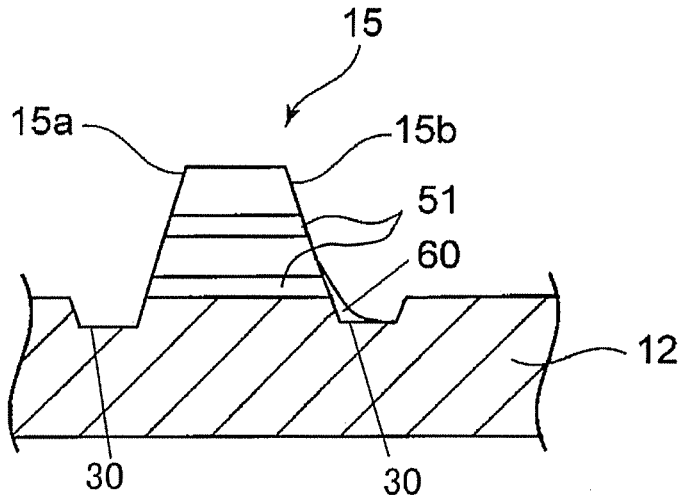
FIG. 5C is still another example of the sectional view of the state in which the insulating member is formed in the chamber grooves.

Subsequently, in Act A5, as shown in FIG. 5A, insulating resin to be formed as the insulating member 60 is applied to cover the chamber groove 30. As shown in FIG. 5A, one chamber groove 30 is provided in each of positions near the slopes 15*a* and 15*b* of the piezoelectric member 15. The insulating resin is applied to at least the chamber groove 30 in which the electric wire 27 explained below is formed. The insulating resin may be selectively formed only in the chamber groove 30 as shown in FIG. 5B. Even if the insulating resin is formed from the chamber groove 30 to the slope of the piezoelectric member 15 as shown in FIG. 5C, whereby air bubbles are present in the adhesive 51 between the substrate 12 and the piezoelectric member 15 and a portion not filled with the adhesive 51 because of the air bubbles is exposed to the surface, it is possible to prevent plating from intruding into the portion not filled with the adhesive 51. After the insulating resin is applied, the insulating resin is hardened to form the insulating member 60. A method of applying the insulating resin can be selected out of a screen printing method, a curtain coat method, a spray coat method, a roll coat method, and the like according to, for example, an inclination degree of the piezoelectric member 15.

As the insulating resin applied to the substrate 12, thermosetting polyimide resin or epoxy resin, photosensitive polyimide resin or epoxy resin, or the like is used.

Examples of the thermosetting polyimide resin include CT4112 manufactured by Kyocera Chemical Corporation. The resin is applied using an instrument such as a spray coater while covering a ground portion on the surface of the substrate 12. After the resin is applied, heating is performed for about one hour in an oven at 200° C. The polyimide resin hardened by the heating is the insulating member 60.

Photosensitive resin of epoxy, polyimide, or the like may be used. The photosensitive resin is applied to the substrate 12 using an instrument such as the spray coater. Thereafter, an ultraviolet ray is irradiated on the substrate 12. The ultraviolet ray irradiation is performed via an exposure mask to leave the resin in a ground portion area on the surface of the substrate 12. Thereafter, the substrate 12 is immersed in development liquid to remove the resin in unnecessary places. If heating is necessary before the substrate 12 is exposed, the heating is performed.

The formation of the insulating member 60 may be performed between Act A2 and Act A3. In this case, the insulating member 60 may be formed over the entire surfaces of the substrate 12 and the piezoelectric member 15. After both the side surfaces 15*a* and 15*b* along the longitudinal direction A of the piezoelectric member 15 are obliquely ground, the thermosetting polyimide resin such as CT 4112 manufactured by Kyocera Chemical Corporation is applied by the spray coater to cover the ground portion on the surface of the substrate 12. At this point, the resin may be applied to cover the entire piezoelectric member 15. Thereafter, heating is performed for about one hour in the oven at 200° C. to form the insulating member 60 and, then, the pressure chamber grooves 24 are formed.

The insulating member 60 is desirably formed in a film shape having maximum thickness of several micrometers to several ten micrometers in order to suppress an amount of use of a material.

Thereafter, etching is performed to roughen the surfaces of the piezoelectric member 15 and the insulating member 60. First, the piezoelectric member 15 is immersed in, for example, acid etching liquid to roughen the surface of the piezoelectric member 15. Subsequently, the insulating member 60 is immersed in, for example, alkali or permaganic acid etching liquid to roughen the surface of the insulating member 60. Average surface roughness is desirably about Ra 0.2 to 0.5 μm.

An electrode forming step performed in Act A6 is explained. The electrodes 26 are formed on the inner surfaces of the plural pressure chamber grooves 24 and the electric wires 27 are formed on the substrate 12. The electrodes 26 and the electric wires 27 are formed of, for example, a nickel thin film formed by electroless plating.

In order to cause the insulating member 60 to absorb a plating catalyst, conditioning treatment, catalyst imparting, and catalyst activation treatment are applied to the insulating member 60 in order. The conditioning treatment is performed to improve an adhesion force of a catalyst such as a palladium complex, which is added later, by immersing the catalyst in a surface active agent.

After the nickel thin film is formed over the entire surfaces of the substrate 12 and the piezoelectric member 15, laser machining is applied to the nickel thin film to remove the nickel thin film in regions other than the electrodes 26 and the wires 27.

Means for removing the nickel thin film in the regions other than the wires 27 is not limited to the laser machining. It is also possible to use means for forming a resist material on the nickel thin film in regions to be formed as wires and melting and removing the nickel thin film in regions other than the wires using etching liquid.

Figure 7:
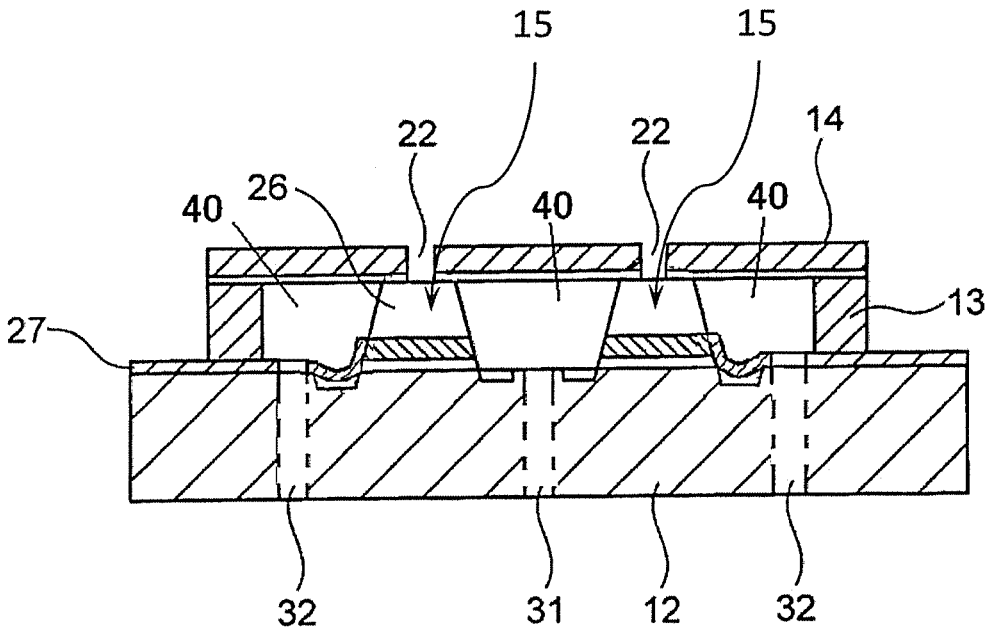
FIG. 7 is a sectional view of a state in which a cover member is bonded to an end of the frame member and ends of walls.

Thereafter, in Act A7, as shown in FIG. 6, the frame member 13 is bonded to the surface of the substrate 12 to surround the pair of piezoelectric members 15. In Act A8, as shown in FIG. 7, the cover member 14 is bonded to cover the frame member 13 and the piezoelectric members 15. As explained above, the cover member 14 is bonded to the end 13*a* (see FIG. 6) of the frame member 13 and the ends 25*a* (see FIG. 6) of the plural walls 25 of the piezoelectric member 15.

Further, thereafter, in Act A9, a laser is irradiated on the cover member 14 to form the plural nozzles 22. Circular ejection ports (orifices) are formed on the surface of the cover member 14 to form the nozzles 22 in positions opposed to the plural pressure chamber grooves 24 to respectively communicate with the pressure chamber grooves 24.

In Act A10, the driving circuits (the ICs 16 for head driving) are attached to be connected to the electric wires 27 on the substrate 12. Further, in Act A11, a not-shown ink case is bonded to the substrate 12. The manufacturing process for the inkjet head 11 ends.

According to the embodiment explained above, even if the substrate made of alumina is used as the substrate 12, by forming the insulating member 60 on a part of the substrate 12 or continuously from a part of the substrate 12 to the inclined portion of the piezoelectric member 15, it is possible to form the electric wires 27 having a high adhesion force without excessively roughening the piezoelectric member 15. Further, it is possible to prevent plating from intruding into air bubbles in the adhesive 51 because of the formation of the insulating member 60.

In this embodiment, the alumna material is used as the substrate 12. However, a mullite material may be used. Mullite ($3Al_2O_3.2SiO_2$) is white or light yellow ceramics having gloss. The raw material of mullite is talc. Mullite is easily machined. In particular, mullite is excellent in electric insulation under a high-temperature environment. Mullite is used in a terminal block, a cap for insulation, and the like. Mullite has a satisfactory high-frequency property and a small high-frequency loss. Therefore, mullite is used in, for example, an insulator terminal for a communication apparatus. Mullite is chemically stable and is acid resistant and alkali resistant. Therefore, like alumina, mullite can be used as a physico-chemical component such as a substrate. Further, mullite has a characteristic that, for example, mullite is robust against a thermal shock. Such mullite may be used for the substrate.

In the embodiment, the insulating member is used. As the insulating member, an insulating resin film is desirable. Even if the inside of the film is conductive, the outer side of the film may be covered with an insulating material. Such a film is not a film formed of the insulating material but is included in the insulating film in the present invention.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet head comprising:

a substrate;

a piezoelectric member provided on the substrate and having predetermined length;

a plurality of pressure chamber grooves provided on the piezoelectric member at equal intervals in a longitudinal direction, opposed walls forming the pressure chamber grooves being configured to function as driving elements that eject ink;

a chamber groove provided along the longitudinal direction of the piezoelectric member, the chamber groove being formed on the substrate continuously to a slope of the piezoelectric member;

an insulating member provided in the chamber groove, the insulating member extending from the chamber groove onto the slope of the piezoelectric member, wherein the insulating member is an insulating resin film;

a wire through which a signal for driving the walls of the pressure chamber grooves passes, the wire being formed on the substrate and the insulating member;

a cover member opposed to the substrate and configured to cover the piezoelectric member and the chamber groove; and a plurality of nozzles configured to pierce through the cover member, respectively communicate with the pressure chamber grooves, and discharge the ink.

2. The inkjet head according to claim 1, wherein the insulating member is formed of an insulating material in a film shape.

3. The inkjet head according to claim 2, wherein the substrate is formed of alumina or mullite.

4. The inkjet head according to claim 1, wherein the substrate is formed of alumina or mullite.

5. The inkjet head according to claim 1, wherein the insulating member is formed of an insulating material in a film shape.

6. The inkjet head according to claim 5, wherein the insulating resin film includes a roughened surface.

7. The inkjet head according to claim 6, wherein the substrate is formed of alumina or mullite.

8. The inkjet head according to claim 5, wherein the substrate is formed of alumina or mullite.

9. The inkjet head according to claim 1, wherein the insulating member is a resin film formed of insulating resin.

10. The inkjet head according to claim 9, wherein the substrate is formed of alumina or mullite.

11. The inkjet head according to claim 1, wherein the substrate is formed of alumina or mullite.

12. A method of manufacturing an inkjet head, comprising:

bonding a piezoelectric member on a substrate;

forming a plurality of pressure chamber grooves provided on the piezoelectric member at equal intervals in a longitudinal direction, opposed walls forming the pressure chamber grooves being configured to function as driving elements that eject ink;

forming a chamber groove provided along the longitudinal direction of the piezoelectric member, the chamber groove being formed on the substrate continuously to a slope of the piezoelectric member;

providing an insulating member in the chamber groove of the substrate the insulating member extending from the chamber groove onto the slope of the piezoelectric member, wherein the insulating member is an insulating resin film;

forming a wire for driving the piezoelectric member on the insulating member and the substrate;

forming a cover member on the piezoelectric member to be opposed to the substrate; and forming an ink ejection hole in the cover member.

13. The method according to claim 12, wherein the insulating member is formed of an insulating material.

14. The method according to claim 12, wherein the insulating member is formed of insulating resin.

15. The method according to claim 12, wherein the substrate is formed of alumina or mullite.

16. A method of manufacturing an inkjet head, comprising:

bonding a piezoelectric member on a substrate;

forming a plurality of pressure chamber grooves provided on the piezoelectric member at equal intervals in a longitudinal direction, opposed walls forming the pressure chamber grooves being configured to function as driving elements that eject ink;

forming a chamber groove provided along the longitudinal direction of the piezoelectric member, the chamber groove being formed on the substrate continuously to a slope of the piezoelectric member;

providing an insulating member from the chamber groove of the substrate onto a slope of the piezoelectric member wherein the insulating member is an insulating resin film;

forming a wire for driving the piezoelectric member on the insulating member and the substrate;

forming a cover member on the piezoelectric member to be opposed to the substrate; and forming an ink ejection hole in the cover member.

17. The method according to claim 16, wherein the substrate is formed of alumina or mullite.

18. An inkjet recording apparatus comprising an inkjet head and a mechanism carrying a recording media to a position which ink droplets ejected from the inkjet head reach, the inkjet head comprising:

a substrate;

a piezoelectric member provided on the substrate and having predetermined length;

a plurality of pressure chamber grooves provided on the piezoelectric member at equal intervals in a longitudinal direction, opposed walls forming the pressure chamber grooves being configured to function as driving elements that eject ink;

a chamber groove provided along the longitudinal direction of the piezoelectric member, the chamber groove being formed on the substrate continuously to a slope of the piezoelectric member;

an insulating member provided in the chamber groove and from the chamber groove to the slope of the piezoelectric member, the insulating member is a resin film formed of insulating resin;

a wire through which a signal for driving the walls of the pressure chamber grooves passes, the wire being formed on the substrate and the insulating member;

a cover member opposed to the substrate and configured to cover the piezoelectric member and the chamber groove; and a plurality of nozzles configured to pierce through the cover member, respectively communicate with the pressure chamber grooves, and discharge the ink.

19. The inkjet recording apparatus according to claim 18, wherein the insulating member is formed of an insulating material in a film shape.

20. The inkjet recording apparatus according to claim 18, wherein the substrate is formed of alumina or mullite.

* * * * *